US006263944B1

(12) United States Patent
Judkins

(10) Patent No.: US 6,263,944 B1
(45) **Date of Patent: *Jul. 24, 2001**

(54) VENETIAN TYPE BLINDS

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

This patent is subject to a terminal disclaimer.

(21) Appl. No.: 08/972,852

(22) Filed: Nov. 18, 1997

Related U.S. Application Data

(63) Continuation of application No. 08/661,192, filed on Jun. 10, 1996, now Pat. No. 5,692,552, which is a continuation of application No. 08/384,136, filed on Feb. 6, 1995, now Pat. No. 5,573,501.

(51) Int. Cl.[7] ..... E06B 9/30
(52) U.S. Cl. ..... 160/168.1 R
(58) Field of Search ..... 160/168.1 R, 170 R, 160/171 R, 172 R, 173 R, 176.1 R, 177 R, 178.1 R

(56) References Cited

U.S. PATENT DOCUMENTS

| | | | | |
|---|---|---|---|---|
| 262,399 | | 8/1882 | Gibson et al. . | |
| 2,140,049 | | 12/1938 | Grauel | 156/10 |
| 2,162,226 | | 6/1939 | McKinney | 156/17 |
| 2,200,349 | * | 5/1940 | Walker | 160/168.1 R X |
| 2,231,778 | | 2/1941 | Swanson | 156/17 |
| 2,307,278 | | 1/1943 | Krantz | 160/173 |
| 2,374,591 | | 4/1945 | Dunn | 160/177 |
| 2,381,060 | | 8/1945 | Kahn | 160/170 |
| 2,397,765 | | 4/1946 | Sylvanus | 160/168 |
| 2,401,283 | | 5/1946 | Williams | 160/173 |
| 2,407,554 | | 9/1946 | Isserstedt | 160/173 |
| 2,572,224 | | 10/1951 | Walker | 160/173 |
| 2,573,700 | | 11/1951 | Ferguson et al. | 160/173 |
| 2,576,159 | | 11/1951 | Walker | 160/178 |
| 2,583,031 | | 1/1952 | Walker | 160/168 |
| 2,587,756 | | 3/1952 | Palmisano | 160/168.1 |
| 2,591,570 | | 5/1952 | Walker | 160/178 |
| 2,632,506 | | 3/1953 | Walker | 160/178 |
| 2,687,770 | | 8/1954 | Walker | 160/176 |
| 2,690,215 | | 9/1954 | Croxen | 160/173 |
| 2,783,831 | | 3/1957 | Moyer | 160/173 |
| 3,294,153 | | 12/1966 | Fountain | 160/163 |
| 3,460,601 | * | 8/1969 | Abraham | 160/168.1 R |
| 4,168,735 | | 9/1979 | Frei | 160/168 |
| 4,200,135 | | 4/1980 | Hennequin | 160/168 |
| 4,621,673 | | 11/1986 | Georgopoulos et al. | 160/168 |
| 4,651,794 | | 3/1987 | Bytheway, Jr. | 160/168 |
| 4,697,630 | | 10/1987 | Rude | 160/166 |
| 4,708,188 | | 11/1987 | Bytheway, Jr. | 160/174 |
| 4,723,586 | | 2/1988 | Spangenberg | 160/107 |
| 4,869,308 | | 9/1989 | Chang | 160/176.1 |
| 4,917,168 | | 4/1990 | Chen | 160/177 |
| 4,940,070 | | 7/1990 | Warden | 160/176.1 |
| 4,951,729 | | 8/1990 | Chi Yu | 160/178.3 |
| 5,060,709 | * | 10/1991 | Simon | 160/168.1 R |
| 5,123,472 | | 6/1992 | Nagashima et al. | 160/170 |
| 5,139,072 | | 8/1992 | Marocco | 160/176.1 |
| 5,207,261 | | 5/1993 | Quezel | 160/176.1 |
| 5,228,491 | | 7/1993 | Rude et al. | 160/176.1 |
| 5,232,037 | | 8/1993 | Fraser | 160/168.1 |
| 5,285,838 | | 2/1994 | Rapp et al. | 160/168.1 |
| 5,309,974 | | 5/1994 | Fraser | 160/176.1 |
| 5,341,865 | | 8/1994 | Fraser et al. | 160/176.1 |
| 5,692,552 | * | 12/1997 | Judkins | 160/168.1 |

FOREIGN PATENT DOCUMENTS

| | | |
|---|---|---|
| 1467038 | 10/1968 | (FR) . |
| 630127 | 11/1949 | (GB) . |

* cited by examiner

*Primary Examiner*—David M. Purol
(74) *Attorney, Agent, or Firm*—Buchanan Ingersoll, P.C.

(57) ABSTRACT

An improved venetian type blind has slats having a pair of slots disposed on an outside edge or inside edge of the slats. The slots in each pair are laterally spaced apart. A first ladder having opposite cord type rails and rungs extends therebetween, is positioned with the rails outside of the slots and is connected to the bottomrail. One rail of each ladder is adjacent to a lift cord running through slots in the inside edge or outside edge of the slats.

22 Claims, 9 Drawing Sheets

81
82
12
13
11
6
13
9
7
6
6
40
3
4

81
82
12
13
11
6
13
9
7
6
6
89
85
88
14

VENETIAN TYPE BLINDS

CROSS REFERENCE TO RELATED APPLICATION

This is a continuation of U.S. patent application Ser. No. 08/661,192 filed Jun. 10, 1996, now U.S. Pat. No. 5,692,552, which is a continuation of U.S. patent application Ser. No. 08/384,136 filed Feb. 6, 1995, and issued Nov. 12, 1996 as U.S. Pat. No. 5,573,501.

FIELD OF INVENTION

The invention relates to a venetian type blind.

BACKGROUND OF THE INVENTION

Venetian type blinds have a series of slats hung on ladders which extend from a headrail to a bottomrail. In most venetian blinds a pair of lift cords is provided each having one end attached to the bottomrail and then passing through elongated holes in the slats up to and through the headrail. A cord lock is usually provided in the headrail through which the lift cords pass. The cord lock allows the user to maintain the blind in any desired position from fully raised to fully lowered.

The slats rest on rungs between rails of the ladders. The blind is in an open position when the rungs are horizontal. To close the blind one lifts one rail while allowing the other to either remain in place or be lowered. This raises one end of each rung tilting the slats. Thus, when the blind is closed there is typically tension on one rail while the other rail of the ladder is not in tension.

The rails originally used for venetian blinds consisted of a fabric tape typically from one to two inches in width. The rungs were also made of fabric strips. Conventionally, the lift cords pass through holes in the slats which were aligned between the rails of the ladder. When the blind was closed, the fabric rails covered the holes. Consequently, there was no concern about light passing through the holes when the blind was in a closed position.

Walker in U.S. Pat. No. 2,572,224 discloses slats for a venetian type blind having a tape type ladder system and two lift cords. One lift cord passes through notches on the inside edges at one end of the slats. The second lift cord passes through notches on the outside edge of the other end of the slats. Each lift cord is positioned behind one of the tape-type ladders. Walker does not disclose any lift mechanism inferring that a standard lift mechanism could be used. In a blind made with Walker's slats the lift cords play no role in maintaining the slats in alignment when the blinds are closed. Rather, the tape-type rails of the ladders maintain the slats in alignment.

Very few tape type ladders are used in blinds today. Rather, the art has adopted ladders formed of cord rails having cord-type rungs between them. Typically, the rungs are multiple strands of cord. However, a single strand of cord has also been used. Frequently, a braided cord is used for the ladder rails. The conventional lift cord arrangement in which the lift cord passes through elongated holes in the slats is used. The lift cords are aligned to be between the rails of the ladders which are provided near opposite ends of the blind. When this type of blind is closed light can pass through the holes in the blind slats. This is readily apparent to anyone looking at the closed blind.

In pleated shades efforts have been made to prevent light from passing through the cord holes by making the holes to be a diameter very close to the diameter of the cord. This is not possible in a venetian type blind where the holes must be elongated to allow the slats to tilt properly.

In the venetian blinds which utilize a cord-type ladder the blinds are opened and closed by lifting or lowering one of the ladder rails relative to the other. In most blinds the lateral position of the ladder rails relative to one another remains unchanged at the headrail. Thus, there will be slack at the top of one of the ladder rails and the center of gravity shifts forward or back when the blind is tilted.

Venetian blind slats are conventionally made of aluminum, plastic or wood. Cord route holes are normally punched into the slat one at a time while the length is cut. Wood slats are usually cut to length by saws so that punching or machining of the holes is done one unit at a time. Moreover, punching of holes through wood slats sometimes causes splintering and the areas around the holes are very difficult to paint or seal. After the cord holes have been drilled, lift cords are passed from the bottomrail through the cord holes to the headrail to complete the assembled blind. After the blind has been assembled in this manner it is not possible to remove the slats from the blind without removing the lift cords making it very difficult to clean the slats in the area of the route holes. Thus, it is a major task to clean or paint the slats in this type of blind. Since the lift cords pass through each slat they prevent tight closure when the blind is tilted to a closed position. Further, the route holes weaken the slats dramatically so that bending more easily occurs at the route holes.

There is a need for a venetian type blind having no holes through the slats. The venetian must operate easily and the slats must maintain alignment when the blind is open and closed and most particularly when the blind is raised and lowered.

SUMMARY OF THE INVENTION

I provide a venetian type blind having a bottomrail, headrail and plurality of slats positioned therebetween. The slats are notched to form slots on their inside edge and outside edge to accommodate lift cords. At least four lift cords pass from the bottomrail to the headrail each passing through a slot on the inside edge or outside edge of each slat. At least two preferably cord-type ladders are provided to hold the slats. The ladders are aligned such that the rails of the ladders are adjacent the lift cords and outside the slots cut in the slats.

A tilt mechanism to close the blind is provided within the headrail which preferably moves the rails together as the tilt mechanism lifts one rail and lowers the other rail relative to one another. Therefore, the center of gravity of the blind is in the same plane throughout the tilt range.

A tube lift may be provided for the lift cords or a cord lock can be provided within the headrail or on the cords outside of the headrail.

Other objects and advantages of the present invention will become apparent from a description of the present preferred embodiments shown in the drawings.

DESCRIPTION OF THE PREFERRED EMBODIMENTS

Figure 3:
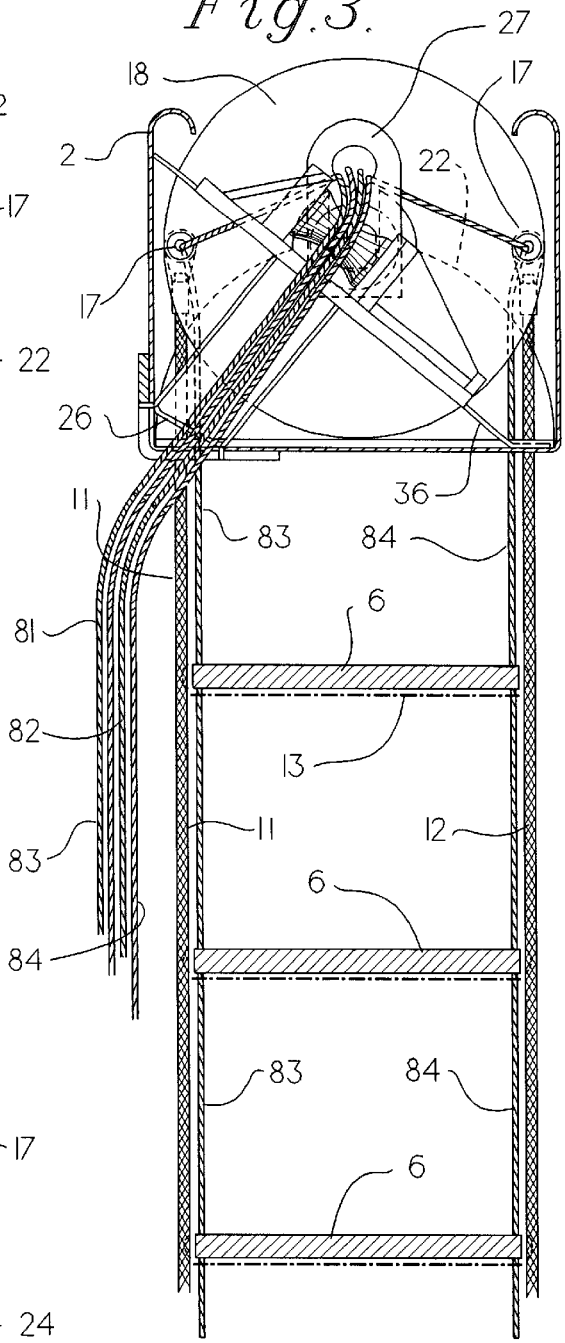
FIG. 3 is a sectional view taken along the line III—III of FIG. 1.
Figure 5:
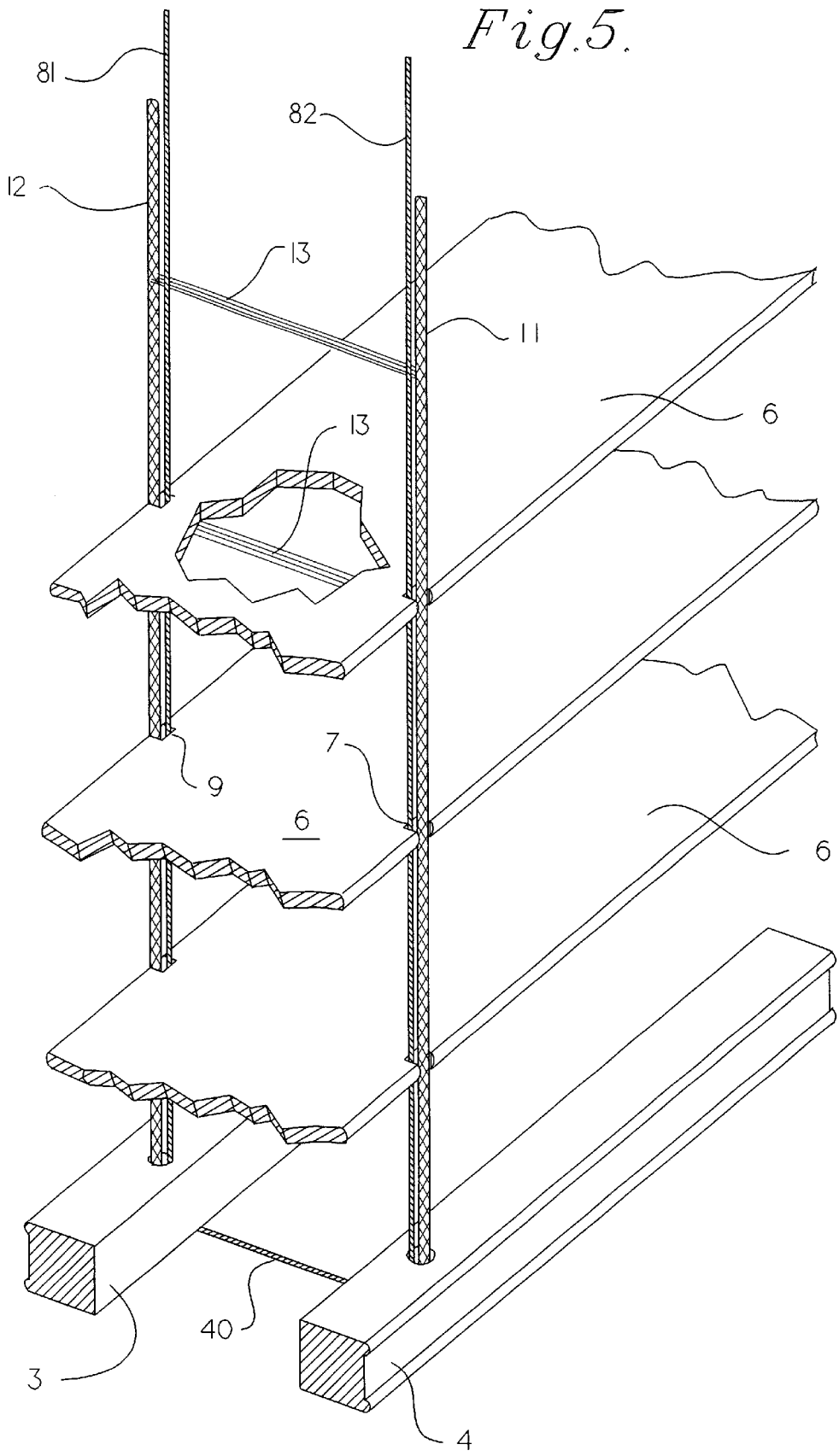
FIG. 5 is a perspective view of a portion of the embodiment shown in FIG. 1 taken around the line V—V of FIG. 1 to show the base of a pair of lift cords and adjacent ladder.
Figure 7:
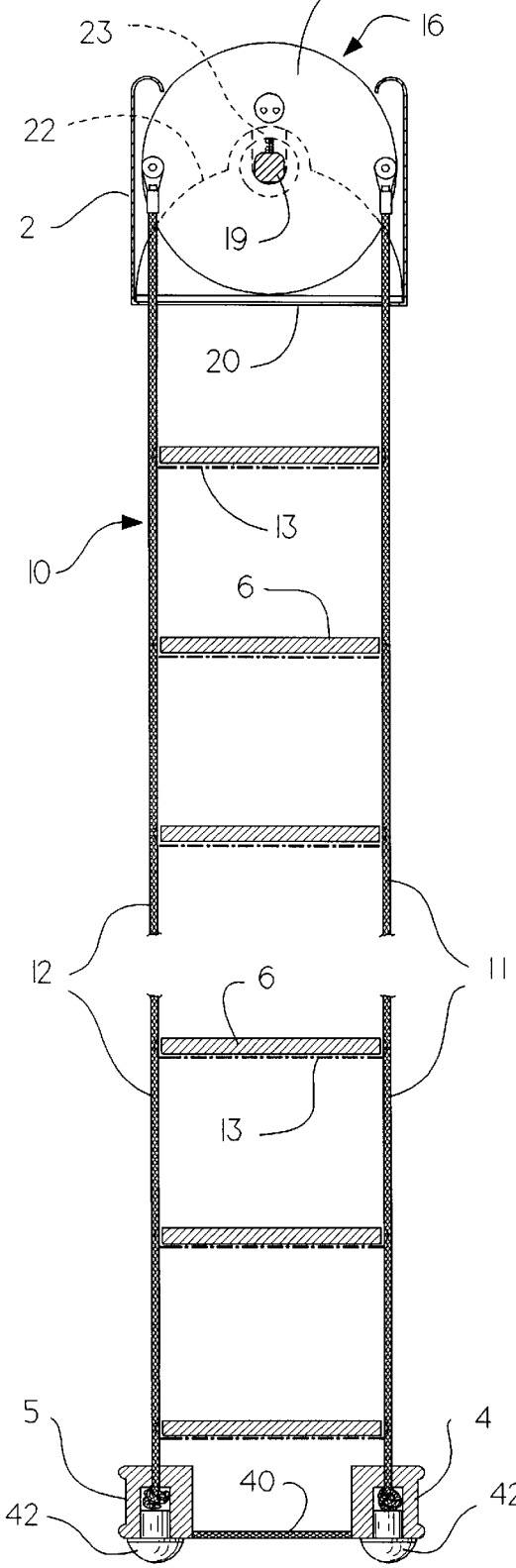
FIG. 7 is a sectional view taken along the line VII—VII in FIG. 1.
Figure 8:
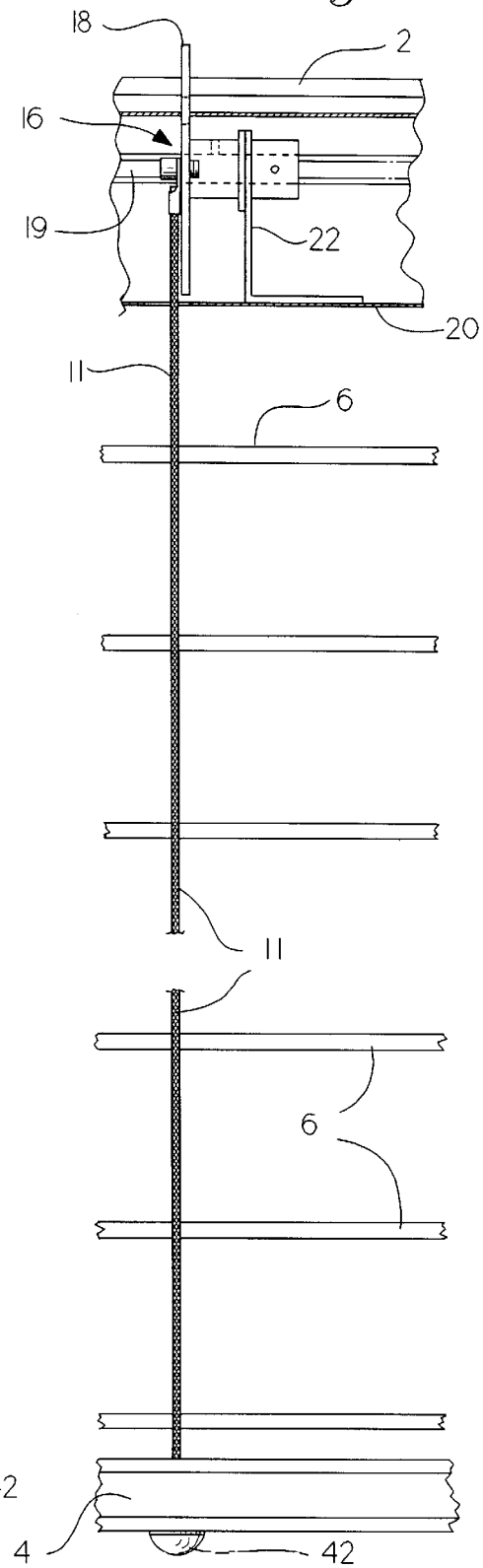
FIG. 8 is a fragmentary view showing the front portion of the blind near the line VII—VII in FIG. 1.

The first present preferred embodiment is comprised of a headrail 2, two piece bottomrail 3 and 4 and set of slats 6 extending therebetween. If desired, a one piece bottomrail could be used. For purposes of illustration only six slats are shown. However, the blind could have any number of slats and likely would have many more slats than are shown. The slats of this embodiment are symmetrical to a horizontal plane passing through the front and back edges of the slat. Crowned slats may be used in place of these flat slats if desired. The slats are suspended on a cord type ladder 10. The ladder has a front rail 11, rear rail 12 and series of rungs 13 extending therebetween on which these slats rest. As shown most clearly in FIG. 7, the bottom ends of the ladders are knotted within the bottomrails 4 and 5 and covered by plugs 42. Cord 40 is provided to tie the bottomrails 4 and 5 together and prevent them from flaring out. At least two front slots 7 are provided on the front edge of each slat 6. A corresponding set of rear slots 9 have been cut into the back edge of slat 6 opposite slots 7. I prefer to have the slots 7 and 9 directly opposite one another as shown in FIG. 5. However, one slot could be to the left or right of the other slot. The slots are sized so that lift cords 81, 82, 83 and 84, which are generally identified by reference number 8, and ends of rungs 13 can loosely fit therein. Tilt ladders 10 are positioned near the ends of the blind so that the rails 11 and 12 are adjacent the lift cords. A third tilt ladder is provided at the center of the blind where no lift cords are needed. Slots 7 and 9 preferably have a depth such that only the lift cords 8 and ends of rungs 13 can completely fit therein. Thus, the rails 11 and 12 can never be fully within the slots. For purposes of illustration the lift cords 8 are shown in chain line in some of the figures so as to distinguish them from the adjacent rails of the tilt ladders or other structures. Because lift cords travel within slots 7 and 9 provided in the slats 6 there are no cord holes in the slats. As can be seen in FIG. 3 the slats 6 rest on rungs 13 of the tilt ladder 10 and can easily be lifted from the rungs for cleaning or repainting.

Figures 1, 2:
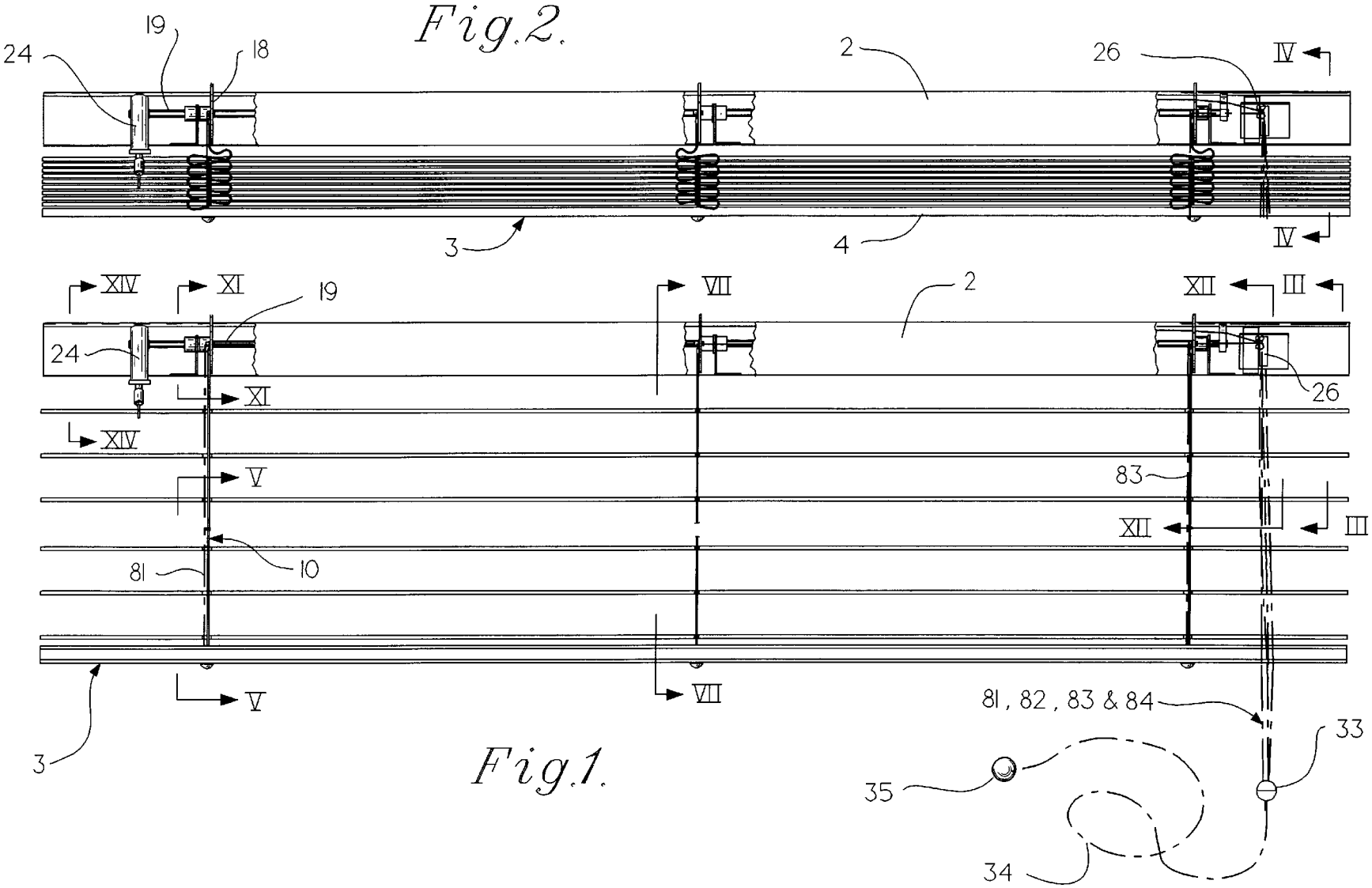
FIG. 1 is a front view of the present preferred embodiment of my venetian type blind shown in a lowered open positioned.
FIG. 2 is a front view similar to FIG. 1 showing an upper portion of the blind when the blind in a raised position.

The number of lift cords that are used will vary according to the size of the blind and the cording arrangement. In every embodiment lift cords 8 should be positioned near either end of the blind in slots on both the front and rear edges of the slats. In the embodiment of FIG. 1 four lift cords extend from the bottomrail through the headrail. As shown most clearly in FIGS. 1 thru 6, lift cords 81 and 83 extend from the front bottomrail 4 through slots 7 in the front edge of slats 6. Lift cords 82 and 84 extend from the rear bottomrail 5 through slots 9 in the rear edge of slats 6. The lift cords 81, 82, 83 and 84 pass through the headrail 2 exiting on the front right side as shown in FIGS. 1 and 2. The lift cords 81, 82, 83 and 84 are threaded through the headrail over pulley 38 and into a cord lock 26 provided in the headrail 2. Support plate 36 is provided to attach the cord lock 26 to the headrail 2. The pulley 38 is held in place by support 37. The cords extend through the cord lock to a position outside and at one end of the blinds. Preferably, the cord lock is always engaging the lift cords unless the blind is being raised or lowered. The distal end of the lift cords may be tied together in a ball connector 33. If desired a pull cord 34 having a tassel 35 may be connected to the ball connector 33. If the bottomrail is supported by the tilt ladders, as in the embodiment of FIG. 1, the weight of the lift cords extending out of the headrail and the attached tassel can provide sufficient tension to hold the slats in place. Moreover, a weight can be placed in the tassel 35 or connector 33 if needed. If the bottomrail is supported only by the lift cords, the weight of the bottomrail maintains the lift cords in tension. Tension in the lift cord prevents lateral motion of the slats.

Figure 9:
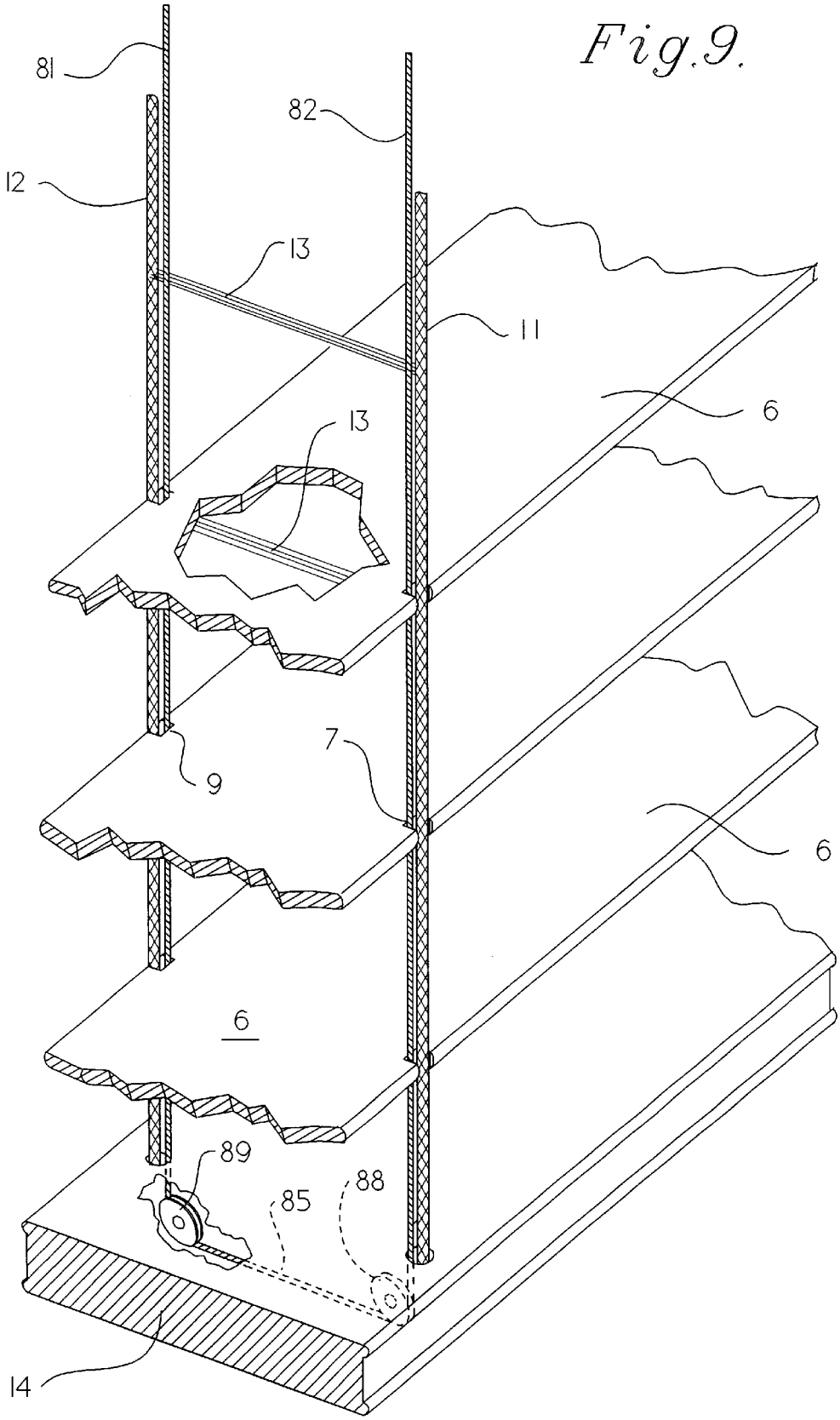
FIG. 9 is a perspective view similar to FIG. 5 showing an alternative routing for the lift cords.
Figure 10:
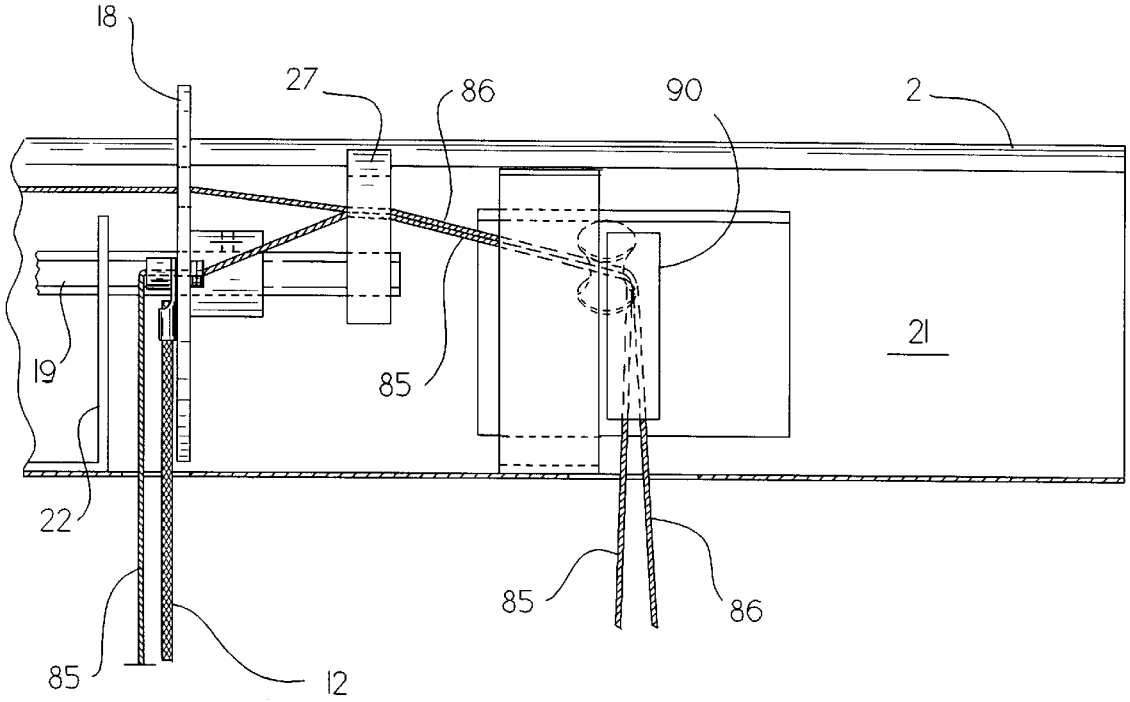
FIG. 10 is a rear view of one end of the headrail with the back panel removed to show the top portion of the alternative lift cord routing of FIG. 9.

An alternative cording arrangement shown in FIGS. 9 and 10 utilizes two lift cords and pulleys in the bottomrail 14. The distal end of each lift cord 85 and 86 is attached to the headrail via the tilt disk 18 thru hole 17. (See FIG. 4) The lift cord 85 and 86 is routed from the headrail down the front of the blind, through the front slats 7, over pulleys 88, across the bottomrails 3, 4, under pulley 89 and up the back of the blind through back slots 9 to the headrail. The cords 85, 86 pass through a cord lock 90 and out of the headrail as shown in FIG. 10. One could also provide a pulley arrangement in which four cords are used and each cord goes up and down in the same set of slots. Yet another arrangement would affix one lift cord at the disk away from the cord lock and route it down the front of the blind through the front bottomrail to the other end of the bottomrail, up the front of the blind, and through a cord lock at the other end of the headrail. A second lift cord would start at the disk near the cord lock and pass through the headrail to the disk at the opposite end and follow a similar path as the first cord back to the disk near the cord lock where it is affixed. A comparable pair of cords travels thru the backside of the blind. In all of those cord routing patterns the lift cords are in tension at all times preventing lateral motion of the slats.

While the lift cords are always in tension, the rails of the tilt ladders are only in tension when the blind is fully lowered. Since the rails are on the outside edges of the slats they can fold neatly across the front of the blind when the blind is raised to the position shown in FIG. 2. Although such neat folding generally occurs, I prefer to assure that such neat folding always occurs by treating the rails with a permanent pleating or other treatment to provide a memory in the rails so that they will fold in the desired manner.

A tilt mechanism 16 is provided to move the rails 11 and 12 of the tilt ladder 10 relative to one another to open and close the blind and also moves the lift cords at the same time.

Figure 11:
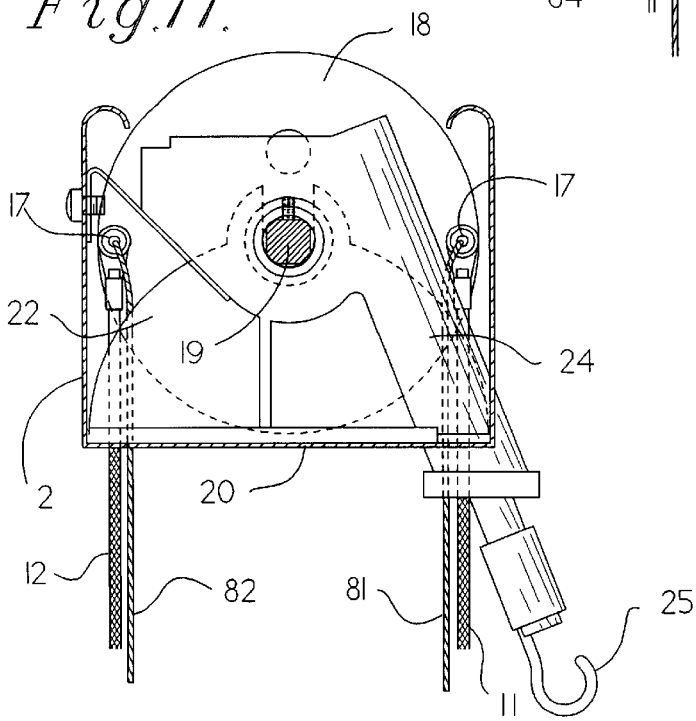
FIG. 11 is a sectional view taken along the line XI—XI of FIG. 1.
Figure 12:
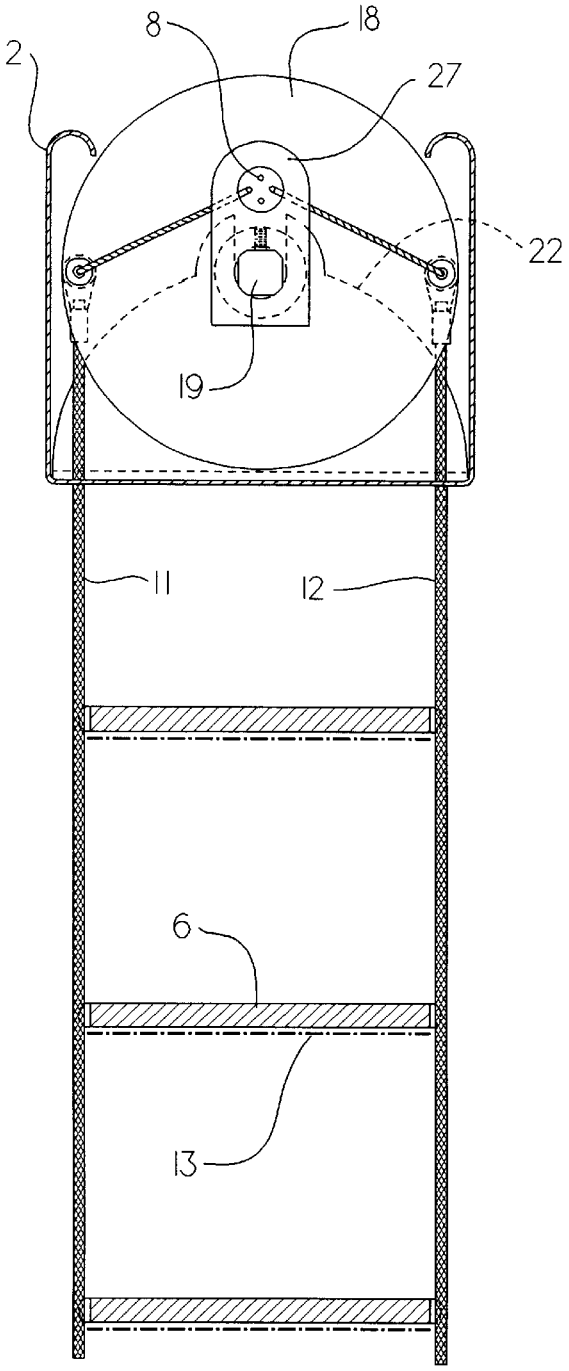
FIG. 12 is a sectional view taken along the line XII—XII of FIG. 1 with the lift cords removed.
Figure 13:
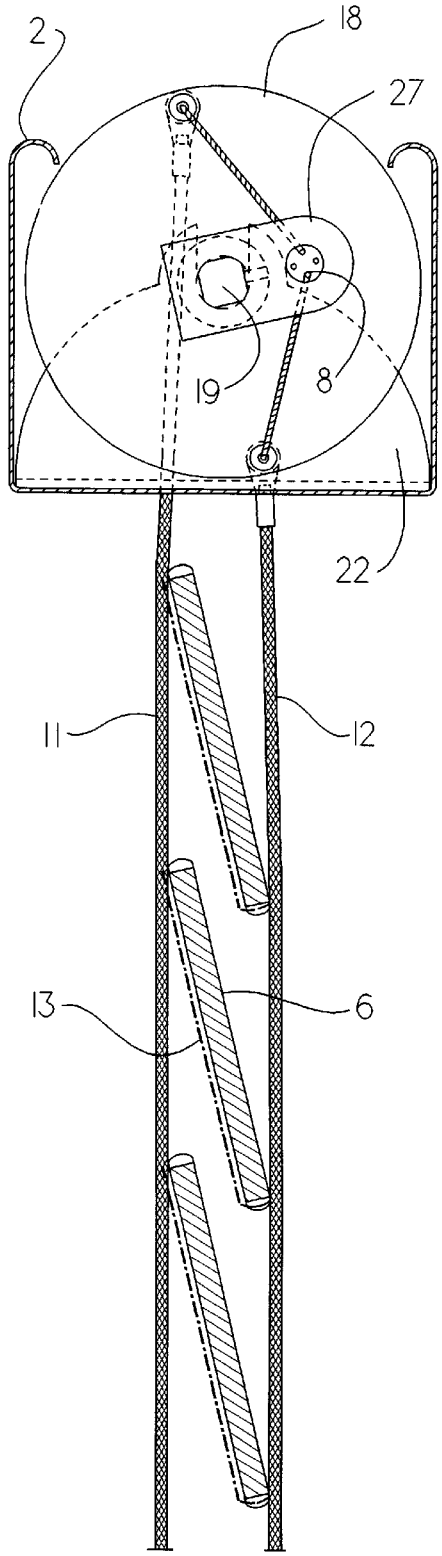
FIG. 13 is a sectional view similar to FIG. 12 showing the blind in a closed position.

The present preferred tilt mechanism can be seen most clearly by referring to FIGS. 4, 3, 7, 8, 11, 12 and 13. The tilt mechanism in the preferred embodiment is comprised of a disk 18 to which the rails 11 and 12 of the tilt ladder 10 are connected. There is one disk for each tilt ladder 10. The disks 18 are mounted on tilt rod 19 so that rotation of the tilt rod will turn the disks in unison. The tilt rod is suspended above the base 20 of the headrail by cradles 22. I prefer to provide a bridge 23 on each cradle to prevent the lift cords from getting caught on the cradles. As shown in FIG. 11, a right angle drive or worm gear drive 24 is provided at one end of tilt rod 19. The drive extends through the headrail 2 to provide a handle 25 which is turned to open and close the blind. Rotation of the disk 18 in either direction lifts one rail 11 or 12 and associated lift cords relative to the other and moves the rails 11 and 12 toward one another. If a two piece bottomrail is used, the front bottomrail will move relative to the rear bottomrail. The same center of gravity should be maintained for the blind through the tilt cycle.. The disks can be rotated 100 degrees. As can be seen in FIGS. 12 and 13, the blind slats 6 will be in a nearly closed position after the disks 18 have been rotated through approximately 90 degrees. As disks 18 are rotated the lift cords 8 and the rails 11 and 12 of the tilt ladders 10 are constantly in tension. This contains the slats and prevents them from slipping laterally. The number of tilt ladders which are used will vary according to the width of the blind.

Figure 4:
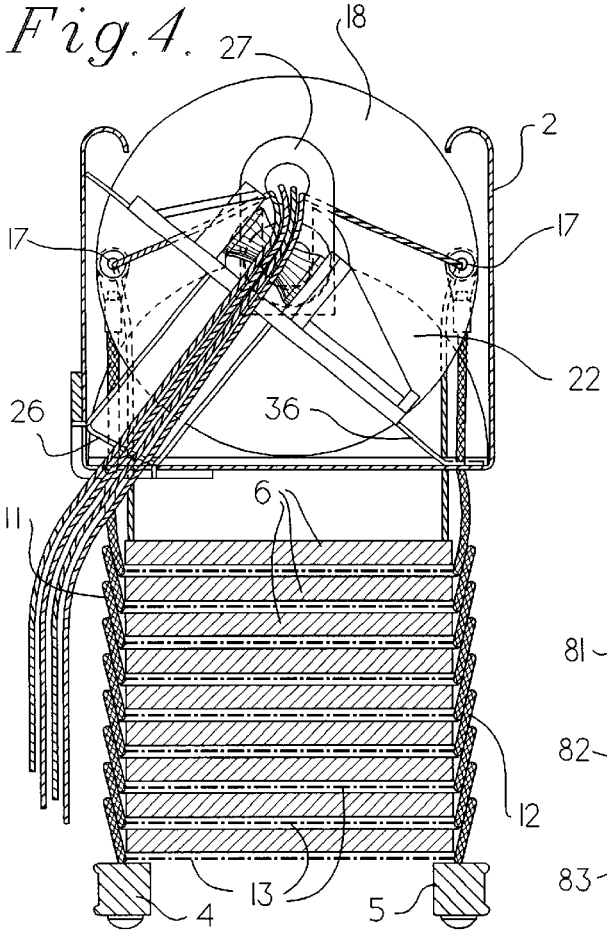
FIG. 4 is a sectional view similar to FIG. 3 taken along the line IV—IV of FIG. 2.
Figure 6:
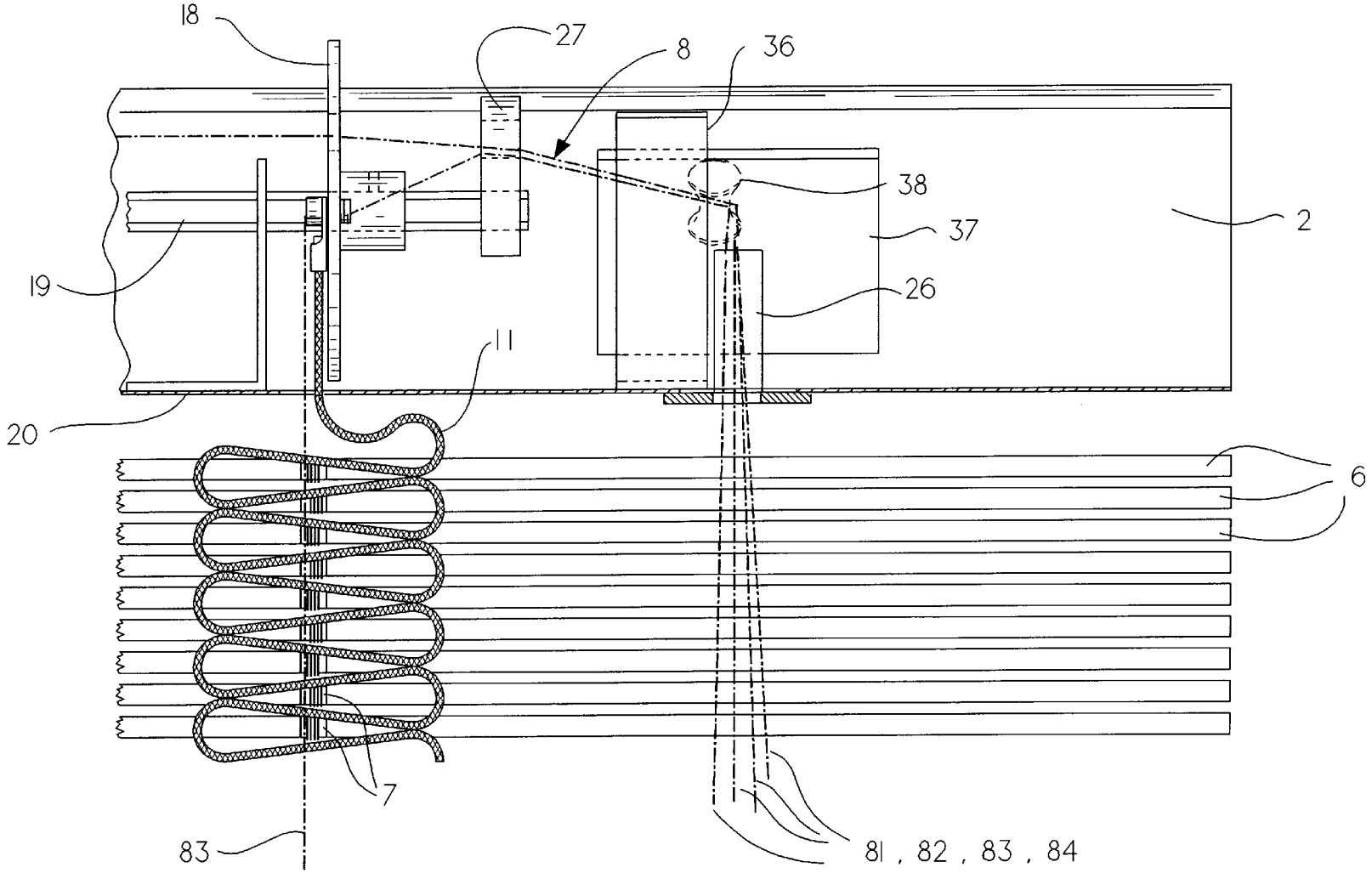
FIG. 6 is a fragmentary view showing the right end of the portion of the raised blind shown in FIG. 2 wherein the front panel of the headrail has been removed.

As can be most clearly seen in FIGS. 3, 4 and 6 the lift cords are routed through pivot holes 17 in the disks 18 located at the point of attachment of the ladder rails 11 and 12. Consequently, rotation of the disk shifts the lift cords transversely and vertically in tandem with the ladder rails and keeps the lift cords under tension. An alignment arm 27 extends from tilt rod 19 through which the lift cords pass to prevent the lift cords from getting caught on the cradles and to present the cords for a uniform entry into the cord lock independent of the tilt angle of the slats.

Figure 14:
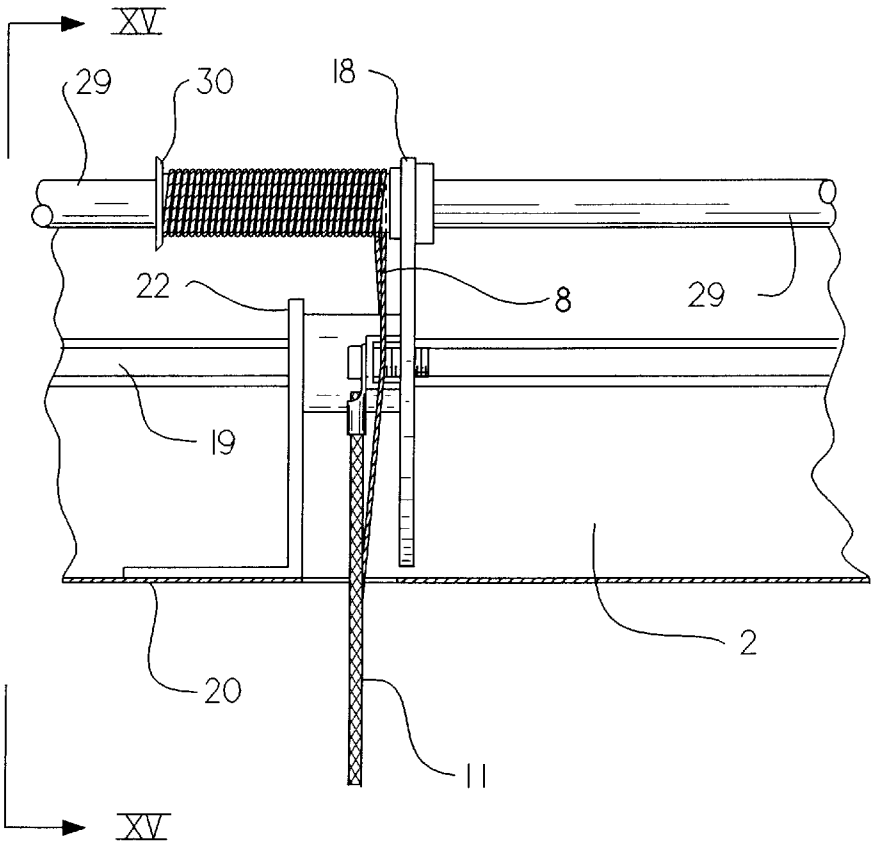
FIG. 14 is a fragmentary view similar to FIG. 6 showing a second preferred embodiment that utilizes a tube lift.
Figure 15:
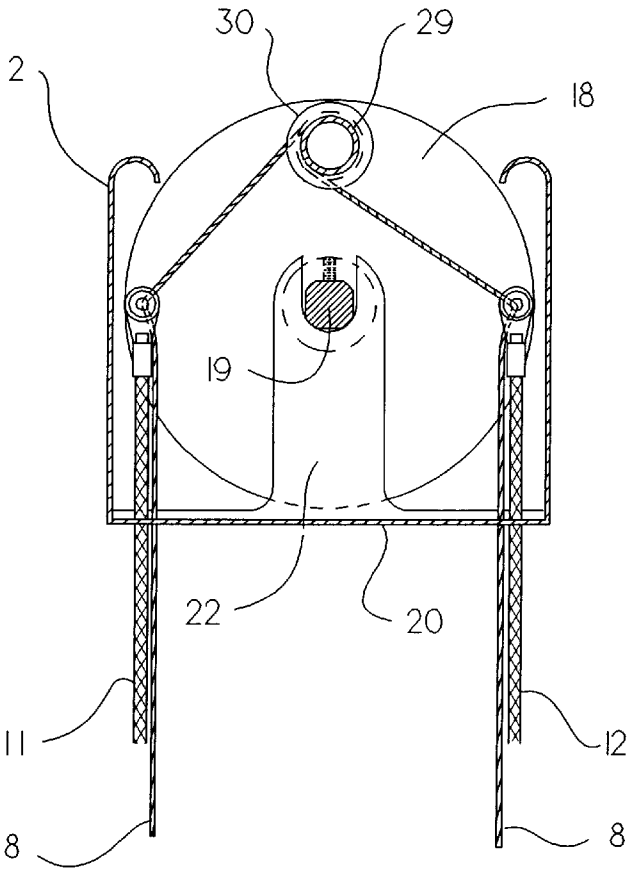
FIG. 15 is a sectional view taken along the line XV—XV of FIG. 14.

In the first preferred embodiment the lift cords 8 pass through the headrail. An alternative is shown in FIGS. 14 and 15 wherein the lift cords are wound about a tubular drive mechanism 30. The drive mechanism includes an axle 29 around which the lift cords 8 are wound. Winding is done such that the lift cord extending from the front is wound in one direction whereas the lift cord extending from the rear is wound in the opposite direction as shown in FIG. 15. Thus, turning of the drive axle 29 will raise or lower the lift cords in the front and back at the same time. A tube lift mechanism such as is disclosed in U.S. Pat. No. 5,184,660 can be adopted for the venetian blind shown in FIGS. 14 and 15.

There are many hardware systems by which the lift cords can be tilted in tandem with the rails of the tilt ladder 10. For example, a set of parallel cradles can be combined with straps or cables and cord locks to form a parallelogram that moves in tandem with the tilt ladder. In another possible arrangement, the disks could be combined with a tilting bar or rotating beam. though I have shown and described certain present preferred embodiments of my venetian blind it should be distinctly understood that the invention is not limited thereto but may be variously embodied within the scope of the following claims.

I claim:

1. A venetian type blind comprising:

a bottomrail;

a plurality of slats above the bottomrail, each slat having a first end and a second end and an inside edge and an outside edge, and each slat having at least a first slot on one of the outside edge and the inside edge proximate the first end of the slat, the first slots forming a first vertically arrayed set of slots, and a second slot on one of the inside edge and the outside edge proximate the second end of the slat and laterally spaced apart from the first slot, the second slots forming a second vertically arrayed set of slots;

a first ladder positioned proximate the first ends of the slats having opposite cord type rails and rungs extending therebetween to support a slat, one of the rails being positioned near the first set of slots, both of said rails being connected to the bottomrail;

a first pair of lift cords adjacent to the first ladder and connected to the bottomrails, one of the lift cords running through the first set of slots;

a second ladder positioned proximate the second ends of the slats having opposite cord type rails and rungs extending therebetween to support a slat, one of the rails being positioned near the second set of slots, both of said rails being connected to the bottomrail;

a second pair of lift cords adjacent to the second ladder and connected to the bottomrail, one of the lift cords running through the second set of slots;

the rungs of each of the ladders extending horizontally between the cord type rails and each being aligned above one another;

the first pair of lift cords being engaged with a plurality of the rungs of the first ladder and the second pair of lift cords being engaged with a plurality of the rungs of the second ladder, such that the rails of the ladders fold substantially in a plane parallel to the edges of the slats when the lift cords draw the slats together;

a headrail above the bottomrail and the plurality of slats through which the lift cords pass; and a tilt mechanism attached to the headrail to which the first and second ladders are attached, such that when the blind is changed from an open position to a closed position the rails of each of the ladders will move relative to one another.

2. The venetian type blind of clam 1 wherein the rails of the ladders are wider than the lift cords and wider than the slots.

3. The venetian type blind of claim 1 further comprising means for preventing the rails of the ladders from fully fitting within the slots.

4. The venetian type blind of claim 3 wherein the prevention means comprises the ladder rails having a dimension greater than the opening of the slots.

5. The venetian type blind of claim 1 wherein the engagement of the lift cords with the ladder rungs comprises the alternate lacing of lift cords with the ladder rungs.

6. The venetian type blind of claim 1 wherein the engagement of the lift cords with the ladder rungs comprises at least one of the lift cords passing through at least one of the ladder rungs.

7. The venetian type blind of claim 1 wherein the ladder rungs are aligned above one another at a distance sufficient to allow the slat supported by such rung to be lifted off the rung for removal from the blind.

8. The venetian type blind of claim 1 wherein the bottomrail is comprised of two spaced apart parallel rails and where one lift cord of each pair of lift cords is attached to one rail and a second lift cord of each pair of lift cords is attached to the other rail.

9. The venetian type blind of claim 1 wherein the lift cords have a diameter smaller than a diameter of the rails of the first and second ladders.

10. The venetian type blind of claim 1 wherein the lift mechanism is comprised of a first cylindrical member to which the rails of the first ladder are attached; a second cylindrical member to which the rails of the second ladder are attached; an axle attached between the first cylindrical member and the second cylindrical member; and means for rotating the axle and attached cylindrical members.

11. The venetian type blind of claim 10, wherein at least one of the lift cords passes through at least one of the cylindrical members.

12. The venetian type blind of claim 10 wherein the means for rotating the axle and attached cylindrical members is one of a right angle drive and a worm drive.

13. The venetian type blind of claim 1 wherein the slats are symmetrical to a plane passing from the front edge to the back edge of the slats.

14. The venetian type blind of claim 1 wherein the slats are one of wood, aluminum and plastic.

15. The venetian type blind of claim 1 also comprising a tube lift attached to the headrail and to which the lift cords are connected.

16. The venetian type blind of claim 1 also comprising four pulleys within the bottomrail and positioned so that one lift cord passes over each pulley.

17. The venetian type blind of claim 1 also comprising a cord lock connected to the lift cords.

18. The venetian type blind of claim 1 wherein the slots have a depth substantially equal to a diameter of the lift cords.

19. The venetian type blind of claim 1 also comprising at least one weight attached to at least one lift cord.

20. The venetian type blind of claim 1 also comprising a cord lock through which the lift cords pass.

21. The venetian type blind of claim 20 wherein the cord lock is always engaged unless the lift cords are being operated.

22. The venetian type blind of claim 1 also comprising a third ladder positioned between the first ladder and the second ladder, the third ladder having opposite cord type rails and rungs extending therebetween to support a slat.

* * * * *